US008057318B2

(12) United States Patent
Chen

(10) Patent No.: US 8,057,318 B2
(45) Date of Patent: Nov. 15, 2011

(54) INFANT SWING

(75) Inventor: Hong-Bo Chen, Taipei (TW)

(73) Assignee: Excellerate Enterprise Co., Ltd., Songshan District, Taipei (TW)

( * ) Notice: Subject to any disclaimer, the term of this patent is extended or adjusted under 35 U.S.C. 154(b) by 185 days.

(21) Appl. No.: 12/555,793

(22) Filed: Sep. 8, 2009

(65) Prior Publication Data

US 2010/0062867 A1 Mar. 11, 2010

Related U.S. Application Data

(60) Provisional application No. 61/095,314, filed on Sep. 9, 2008.

(51) Int. Cl.
*A63G 9/16* (2006.01)
*A63G 9/00* (2006.01)

(52) U.S. Cl. ..... 472/119

(58) Field of Classification Search ..... 472/118–125; 297/273, 274, 284
See application file for complete search history.

(56) References Cited

U.S. PATENT DOCUMENTS

| | | | | |
|---|---|---|---|---|
| 5,975,631 | A * | 11/1999 | Fair et al. | 297/281 |
| 6,059,667 | A * | 5/2000 | Pinch | 472/119 |
| 6,319,138 | B1 | 11/2001 | Fair | |
| 6,626,766 | B1 * | 9/2003 | Hsia | 472/119 |
| 6,705,950 | B2 * | 3/2004 | Wood et al. | 472/118 |
| 6,902,489 | B2 * | 6/2005 | Greger et al. | 472/118 |
| 2003/0199329 | A1 | 10/2003 | Wood | |
| 2006/0194639 | A1 | 8/2006 | Greger | |

FOREIGN PATENT DOCUMENTS

| | | | |
|---|---|---|---|
| CN | 1541595 | A | 11/2004 |
| CN | 2891852 | Y | 4/2007 |
| CN | 101254057 | A | 9/2008 |
| GB | 2 399 769 | A | 9/2004 |
| GB | 2 451 351 | A | 1/2009 |
| WO | 2006058145 | A2 | 6/2006 |
| WO | 2006058145 | A3 | 6/2006 |
| WO | WO 2006058145 | A2 | 6/2006 |

* cited by examiner

*Primary Examiner* — Kien Nguyen
(74) *Attorney, Agent, or Firm* — Winston Hsu; Scott Margo

(57) ABSTRACT

An infant swing includes a support frame, a holding frame, a driving device, and a power supply device. The support frame includes a first connecting port, a second connecting port, and a leg assembly. Two ends of the leg assembly are connected to the first connecting port and the second connecting port. The holding frame is pivoted to the first connecting port and the second connecting port. The driving device is disposed on the first connecting port for driving the holding frame to swing relative to the support frame. The power supply device is disposed on the leg assembly and is electrically connected to the driving device. The power supply device is used for providing the driving device with power for driving the holding frame.

18 Claims, 2 Drawing Sheets

INFANT SWING

CROSS REFERENCE TO RELATED APPLICATIONS

This application claims the benefit of U.S. Provisional Application No. 61/095,314, which was filed on Sep. 9, 2008 and is incorporated herein by reference.

BACKGROUND OF THE INVENTION

1. Field of the Invention

The present invention relates to an infant swing, and more specifically, to an infant swing having a driving device and a power supply device that are disposed separately.

2. Description of the Prior Art

In general, a conventional infant swing usually has a power supply device (e.g. assembly of a battery and a battery holder) for performing functions of music, swing, and so on. A common method for disposing a power supply device on an infant swing involves disposing the power supply device in a driving hub which is used for driving the infant swing to swing. However, since other related components (e.g. a motor) have already installed in the driving hub, the driving hub may require extra containing space for accommodating the power supply device, so that configuration of other components in the driving hub may be effected. Thus, if the power supply device is disposed in the driving hub of the infant swing, the occupied space of the driving hub on the infant swing may effect the appearance of the infant swing, so that flexibility in structural design of the infant swing will be reduced correspondingly.

SUMMARY OF THE INVENTION

The present invention provides an infant swing comprising a support frame comprising a first connecting port, a second connecting port, and a leg assembly, two ends of the leg assembly being connected to the first connecting port and the second connecting port; a holding frame pivoted to the first connecting port and the second connecting port; a driving device disposed on the first connecting port for driving the holding frame to swing relative to the support frame; and a power supply device disposed on the leg assembly and electrically connected to the driving device for providing the driving device with power.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
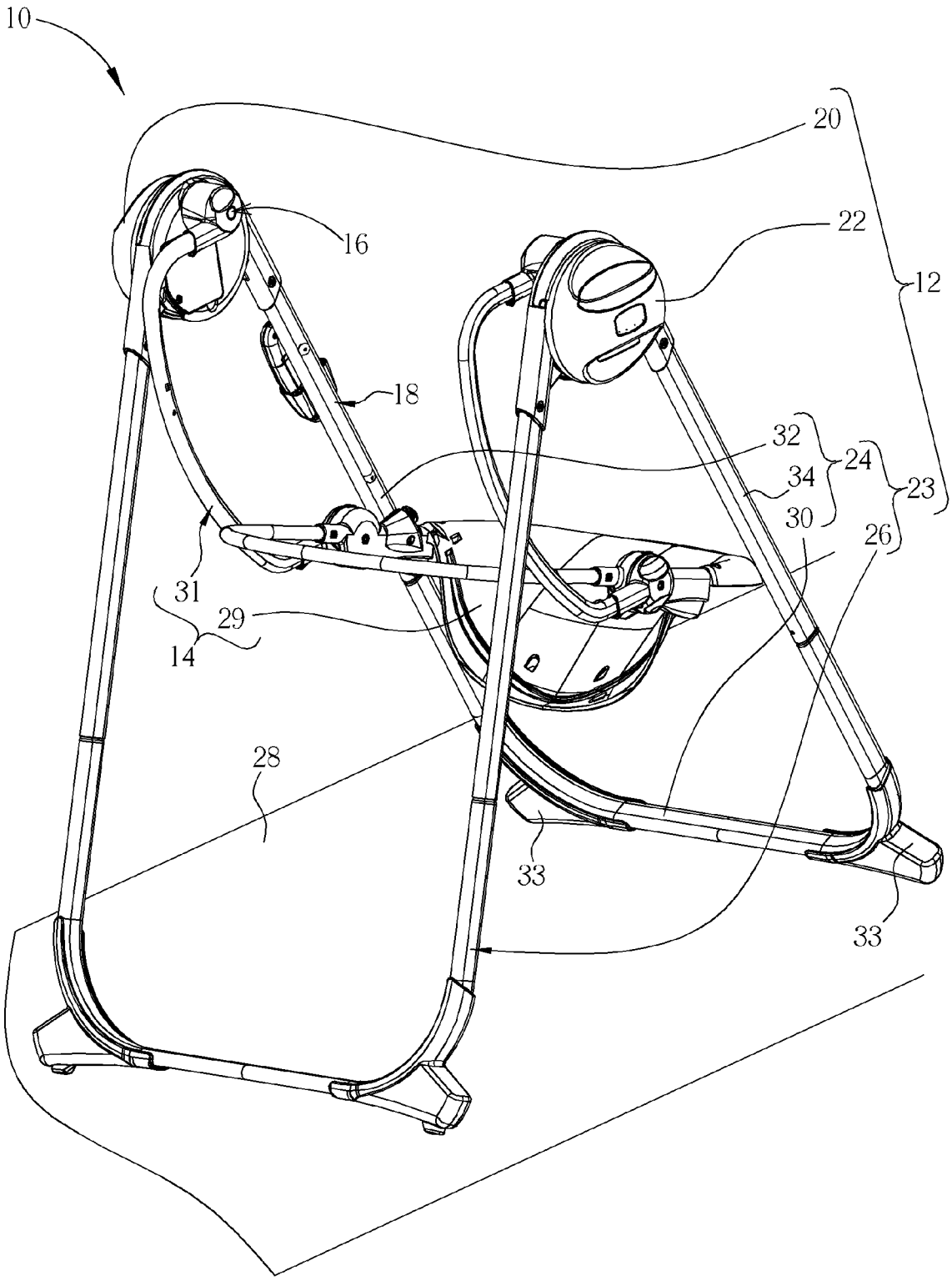
FIG. 1 is a diagram of an infant swing according to a preferred embodiment of the present invention.

As shown in FIG. 1, in a preferred embodiment of the present invention, an infant swing 10 includes a support frame 12, a holding frame 14, a driving device 16, and a power supply device 18. The support frame 12 includes a first connecting port 20, a second connecting port 22, and a leg assembly 23. In this embodiment, the leg assembly 23 includes, but is not limited to, two leg frames 24, 26. In other embodiment, the leg assembly 23 may also be other common structure, such as an L-shaped leg frame or one leg frame which is connected to the middle part of the other leg frame, etc. The leg frames 24, 26 are connected to the first connecting port 20 and the second connecting port 22 for supporting the holding frame 14 on a bearing surface 28. The holding frame 14 is pivoted to the first connecting port 20 and the second connecting port 22 so that the holding frame 14 can be hanged at a specific height relative to the bearing surface 28 and swing relative to the support frame 12. The holding frame 14 includes a carrier part 29 and an arm 31 connected to the carrier part 29. In this embodiment, the carrier part 29 may preferably be an infant seat or a support rack which an infant seat or a car safety seat may be detachably disposed on, but is not limited thereto. The driving device 16 is used for driving the holding frame 14 to swing relative to the support frame 12. The driving device 16 may be a common device for providing power, such as a motor. The power supply device 18 is disposed on the leg frame 24 and is electrically connected to the driving device 16 for providing the driving device 16 with power for driving the holding frame 14.

Figure 2:
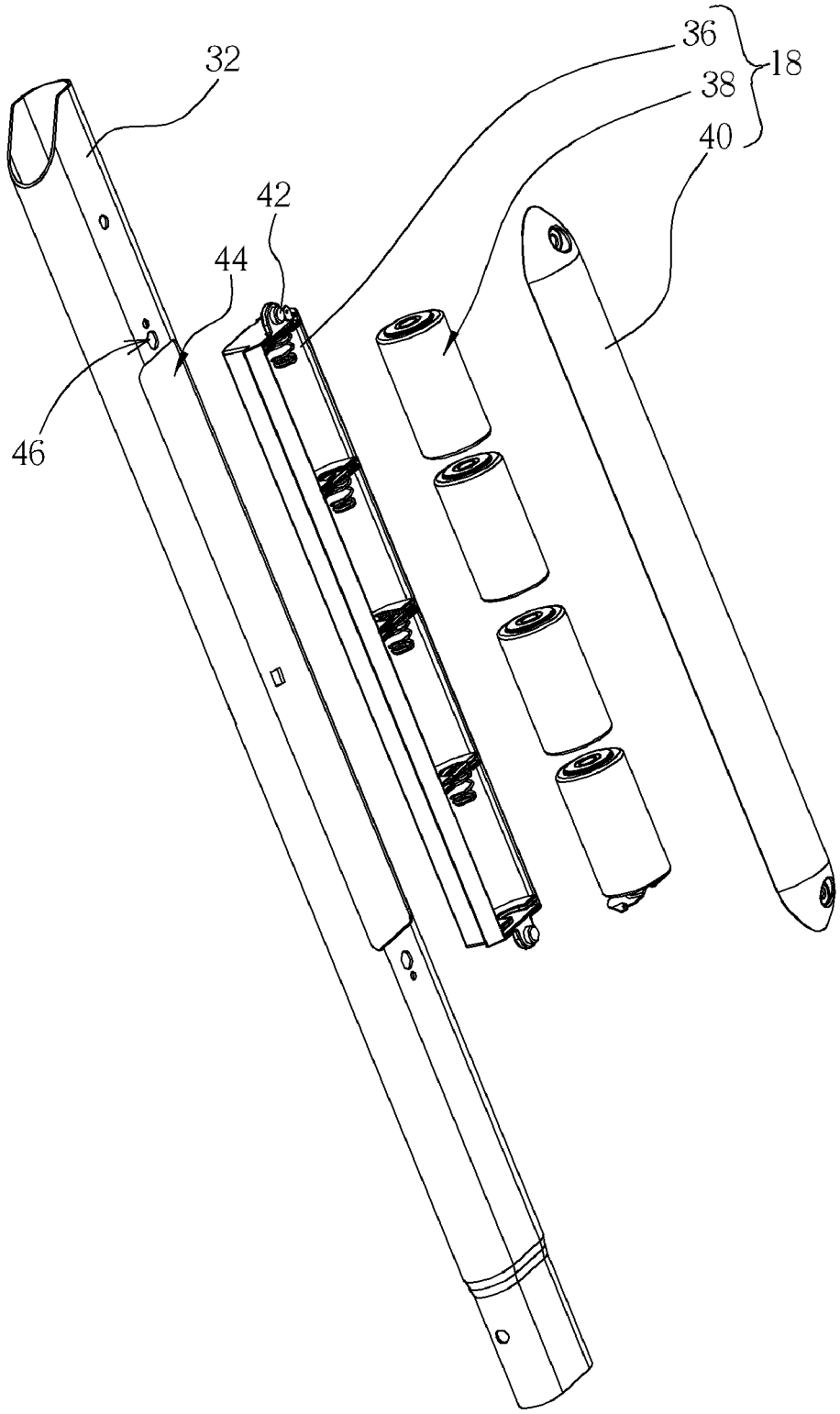
FIG. 2 is an exploded diagram of a power supply device in FIG. 1.

Furthermore, as shown in FIG. 2, the leg frame 24 includes a support base 30, a first leg 32 and a second leg 34. The support base 30 abuts against the bearing surface 28 for supporting the first leg 32 and the second leg 34 on the bearing surface 28. The first leg 32 is connected to the first connecting port 20 and the support base 30. The second leg 34 is connected to the second connecting port 22 and the support base 30. In this embodiment, the first leg 32, the second leg 34, and the support base 30 are formed integrally. Both ends of the support base 30 have a foot piece 33 for providing steady support. Structural design of the leg frame 26 may preferably be the same as that of the leg frame 24, and the related description is therefore omitted herein. The power supply device 18 includes a battery holder 36, at least one battery 38 (four shown in FIG. 2), and a lid 40. The battery holder 36 is disposed on the first leg 32. One end of the battery holder 36 has a first engaging part 42. The first leg 32 is formed with a containing space 44 corresponding to the battery holder 36 and a second engaging part 46 corresponding to the first engaging part 42. The first engaging part 42 is used for engaging with the second engaging part 46 for fixing the battery holder 36 to the first leg 32. The first engaging part 42 and the second engaging part 46 may be matched structures for engaging with each other. For example, as shown in FIG. 2, the first engaging part 42 may preferably be a protrusion of the battery holder 36 and the second engaging part 46 may preferably be a hole of the first leg 32 in this embodiment. The battery 38 is installed in the battery holder 36. In this embodiment, the battery 38 may preferably be one of a carbon-zinc battery, an alkaline battery, and a rechargeable battery. As for which type of battery is utilized, it depends on practical applications of the infant swing 10. The lid 40 is disposed on the first leg 32 and located above the battery holder 36 for covering the battery 38.

More detailed description for assembly of the power supply device 18, the support frame 12, and the driving device 16 is provided as follows. First, the battery holder 36 is disposed in the containing space 44 of the first leg 32. Next, the first engaging part 42 of the battery holder 36 is protrusively engaged with the second engaging part 46 of the first leg 32 from the inner side of the first leg 32, so that the battery holder 36 is secured within the containing space 44. After fixing the battery holder 36 to the first leg 32, the battery holder 36 is electrically connected to the driving device 16. The electrical connection between the battery holder 36 and the driving device 16 can use any common way. For example, the battery holder 36 may utilize a wire disposed inside the first leg 32 to electrically connect to the driving device 16. Next, the battery 38 as shown in FIG. 2 may be sequentially installed in the battery holder 36. At this time, as mentioned above, power provided by the battery 38 can be transmitted to the driving device 16 by the electrical connection between the battery holder 36 and the driving device 16. After installing the battery in the battery holder 36, the lid 40 is then fixed to the first leg 32 by a fastening device (e.g. a screw) and covers the battery 38 installed in the battery holder 36 for covering the battery 38 and preventing particles from entering the battery holder 36 and a short circuit or an broken circuit happening. In such a manner, via the aforementioned configuration of respectively disposing the power supply device 18 and the driving device 16 on different locations of the infant swing 10, the present invention may effectively reduce the occupied space of the structure for accommodating the driving device 16. Furthermore, via the said configuration of disposing the power supply device 18 on the first leg 32 located between the first connecting port 20 and the support base 30, the present invention may keep the power supply device 18 away from the bearing surface 28 at a specific height, so as to protect the power supply device 18 from water and prevent electric leakage of the power supply device 18.

It should be mentioned that disposal of the driving device 16 and the power supply device 18 is not limited to the said embodiment since the infant swing 10 is a symmetrical structure. For example, structural design of the leg frame 26 may be the same as that of the leg frame 24 so that the power supply device 18 may be installed in a leg of the leg frame 26 instead. Accordingly, the driving device 16 may also need to be installed on the second connecting port 22 instead. Furthermore, number of the driving device 16 and the power supply device 18 is also not limited. For example, the driving device 16 may be installed on the first connecting port 20 and the second connecting port 22 respectively for providing the holding frame 14 with power more steadily. Correspondingly, it is also necessary to dispose the power supply device 18 on the leg frame 24 and the leg frame 26 respectively. Furthermore, the same structure as the first engaging part 42 may also be formed on another end of the battery holder 36 (as shown in FIG. 2), and the same structure as the second engaging part 46 may need to be formed on the first leg 32 correspondingly. In such a manner, via a method of engaging two ends of the battery holder 36 with the first leg 32 respectively, the battery holder 36 is secured within the containing space 44 of the first leg 32 more firmly.

Compared with the prior art, in which a driving device and a power supply device of an infant swing are both installed inside the same structure, the present invention involves disposing the power supply device on a leg of the infant swing instead. In such a manner, the present invention may not only reduce the occupied space of the structure for accommodating the driving device effectively so as to reduce manufacturing cost of the infant swing and make structural design of the infant swing more flexibly, but also keep the power supply device away from a bearing surface at a specific height so as to protect the power supply device from water and prevent electric leakage of the power supply device.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An infant swing comprising:

a support frame comprising a first connecting port, a second connecting port, and a leg assembly, two ends of the leg assembly being connected to the first connecting port and the second connecting port, a containing space being formed on the leg assembly;

a holding frame pivoted to the first connecting port and the second connecting port;

a driving device disposed on the first connecting port for driving the holding frame to swing relative to the support frame; and a power supply device disposed on the leg assembly and electrically connected to the driving device for providing the driving device with power, the power supply device having a first engaging part, the leg assembly having a second engaging part corresponding to the first engaging part, the first engaging part being used for engaging with the second engaging part so as to fix the power supply device to the containing space.

2. The infant swing of claim 1, wherein the leg assembly comprises two leg frames, each leg frame is connected to the first connecting port and the second connecting port for supporting the holding frame on a bearing surface, and the power supply device is disposed on one of the leg frames.

3. The infant swing of claim 2, wherein the leg frame comprises:

a support base;

a first leg connected to the first connecting port and the support base, the power supply device being disposed on the first leg; and a second leg connected to the second connecting port and the support base.

4. The infant swing of claim 1, wherein the power supply device comprises:

a battery holder disposed in the containing space;

a battery installed inside the battery holder; and a lid disposed on the leg assembly for covering the battery.

5. The infant swing of claim 4, wherein the lid is fixed to the leg assembly by a fastening device.

6. The infant swing of claim 1, wherein the power supply device comprises:

a battery holder disposed in the containing space and having the first engaging part;

a battery installed inside the battery holder; and a lid disposed on the leg assembly for covering the battery.

7. The infant swing of claim 1, wherein the first engaging part is a protrusion, and the second engaging part is a hole.

8. The infant swing of claim 1, wherein the holding frame comprises:

a carrier part; and an arm connected to the carrier part and the driving device.

9. The infant swing of claim 8, wherein the carrier part is an infant seat.

10. The infant swing of claim 1, wherein the leg assembly has a leg frame comprising:

a first leg connected to the first connecting port, the power supply device being disposed on the first leg;

a second leg connected to the second connecting port; and a support base disposed between the first leg and the second leg.

11. An infant swing comprising:

a support frame comprising a first connecting port, a second connecting port, and a leg assembly, the leg assembly comprising two leg frames, one of the two leg frames comprising a containing space;

a holding frame pivoted to the first connecting port and the second connecting port;

a driving device disposed on the first connecting port for driving the holding frame to swing relative to the support frame; and a power supply device contained in the containing space and electrically connected to the driving device for providing the driving device with power;

wherein two ends of each leg frame are connected to the first connecting port and the second connecting port for holding the holding frame on a bearing surface.

12. The infant swing of claim 11, wherein the leg frame comprises:

a support base;

a first leg connected to the first connecting port and the support base, the power supply device being disposed on the first leg; and a second leg connected to the second connecting port and the support base.

13. The infant swing of claim 11, wherein the power supply device comprises:

a battery holder disposed in the containing space;

a battery installed inside the battery holder; and a lid disposed on the leg assembly for covering the battery.

14. The infant swing of claim 13, wherein the lid is fixed to the leg assembly by a fastening device.

15. The infant swing of claim 11, wherein the holding frame comprises:

a carrier part; and an arm connected to the carrier part and the driving device.

16. The infant swing of claim 15, wherein the carrier part is an infant seat.

17. The infant swing of claim 11, wherein the leg assembly has a leg frame comprising:

a first leg connected to the first connecting port, the power supply device being disposed on the first leg;

a second leg connected to the second connecting port; and a support base disposed between the first leg and the second leg.

18. An infant swing comprising:

a support frame comprising a first connecting port, a second connecting port, and a leg assembly, the leg assembly comprising two leg frames, one of the two leg frames being a tubular form and comprising a containing space within;

a holding frame pivoted to the first connecting port and the second connecting port;

a driving device disposed on the first connecting port for driving the holding frame to swing relative to the support frame; and a power supply device positioned within the containing space and electrically connected to the driving device.

* * * * *